US010150013B2

(12) United States Patent
Paarporn

(10) Patent No.: US 10,150,013 B2
(45) Date of Patent: Dec. 11, 2018

(54) ROLLBACK BALL

(71) Applicant: Somchai Paarporn, N. Potomac, MD (US)

(72) Inventor: Somchai Paarporn, N. Potomac, MD (US)

(73) Assignee: Somchai Paarporn, Potomac, MD (US)

( * ) Notice: Subject to any disclaimer, the term of this patent is extended or adjusted under 35 U.S.C. 154(b) by 0 days.

(21) Appl. No.: 15/131,397

(22) Filed: Apr. 18, 2016

(65) Prior Publication Data

US 2017/0296880 A1 Oct. 19, 2017

(51) Int. Cl.

| | |
|---|---|
| ***A63B 43/04*** | (2006.01) |
| ***A63B 43/00*** | (2006.01) |
| ***A63H 33/26*** | (2006.01) |
| ***A63H 29/00*** | (2006.01) |
| ***A63H 33/00*** | (2006.01) |
| ***A63H 15/00*** | (2006.01) |

(52) U.S. Cl.

CPC ..... *A63B 43/00* (2013.01); *A63H 15/00* (2013.01); *A63H 29/00* (2013.01); *A63H 33/005* (2013.01); *A63H 33/26* (2013.01)

(58) Field of Classification Search

CPC ..... A63H 1/00; A63H 29/00; A63H 33/26; A63B 43/00; A63B 43/04

See application file for complete search history.

(56) References Cited

U.S. PATENT DOCUMENTS 1,263,262 A * 4/1918 McFaul ..... A63H 33/005 180/10
2,633,664 A * 4/1953 Neilson ..... A63H 1/18 446/257
2,949,697 A * 8/1960 Licitis ..... A63H 33/005 200/52 R
2,977,714 A * 4/1961 Gibson ..... A63H 33/005 446/458
3,048,921 A * 8/1962 Johnson ..... A01G 3/06 172/15
3,453,773 A * 7/1969 Compton ..... A63H 33/005 446/458
3,687,452 A * 8/1972 Thompson ..... A63B 43/00 273/317
3,722,134 A * 3/1973 Merrill ..... A63H 33/005 446/130
3,798,835 A * 3/1974 McKeehan ..... A63H 33/005 446/442
3,981,098 A * 9/1976 Darda ..... F03G 1/02 446/464
4,303,209 A * 12/1981 Stephenson ..... B60R 22/44 242/372
4,541,814 A * 9/1985 Martin ..... A63H 33/005 446/456

(Continued)

*Primary Examiner* — Melba Bumgarner
*Assistant Examiner* — Amir Klayman
(74) *Attorney, Agent, or Firm* — Berenato & White, LLC

(57) ABSTRACT

The Rollback Ball or Ballmerang is a ball toy consisting of a ball shell and a mechanical tracking device tracking the ball shell by using friction force or magnetic force converting the moving ball kinetic energy to potential energy, and then releasing the potential energy rolling the ball back at the same straight line path to the same launching destination when rolling the ball in any direction on a flat floor.

13 Claims, 1 Drawing Sheet

(56) References Cited

U.S. PATENT DOCUMENTS 4,925,428 A * 5/1990 Sonesson ..... A63B 43/04 446/324
5,401,201 A * 3/1995 Muraki ..... A63H 5/00 446/409
5,409,414 A * 4/1995 Sheang ..... A63H 33/005 446/443
5,525,086 A * 6/1996 Gentile ..... A63H 27/10 446/234
5,683,284 A * 11/1997 Christen ..... A63H 1/00 446/233
5,692,946 A * 12/1997 Ku ..... A63H 33/005 446/456
5,871,386 A * 2/1999 Bart ..... A63H 15/06 446/443
5,924,909 A * 7/1999 Yamakawa ..... A63H 33/005 446/442
5,947,793 A * 9/1999 Yamakawa ..... A63H 33/005 446/431
6,289,263 B1 * 9/2001 Mukherjee ..... A63H 33/005 700/245
6,414,457 B1 * 7/2002 Agrawal ..... A63H 33/005 180/21
6,458,008 B1 * 10/2002 Hyneman ..... A63H 1/00 446/233
6,575,649 B1 * 6/2003 Kuan-Hsiung ..... B43K 23/02 211/69.5
6,855,028 B2 * 2/2005 Siegel ..... A63B 43/04 446/456
7,726,422 B2 * 6/2010 Sun ..... B62D 57/00 180/21
8,137,152 B2 * 3/2012 Tsai ..... A63H 33/005 446/409
8,210,289 B1 * 7/2012 Lu ..... B62D 57/02 180/10
8,950,552 B2 * 2/2015 Charbon ..... G04B 1/145 185/40 A
9,428,019 B1 * 8/2016 Muhlrad ..... B60F 3/0007
2004/0241394 A1 * 12/2004 Burrows ..... A63H 33/26 428/195.1
2005/0107192 A1 5/2005 Desmarais
2014/0345957 A1 * 11/2014 Bernstein ..... B60R 11/00 180/21
2015/0283436 A1 * 10/2015 Daugard ..... A63B 57/00 473/150

* cited by examiner

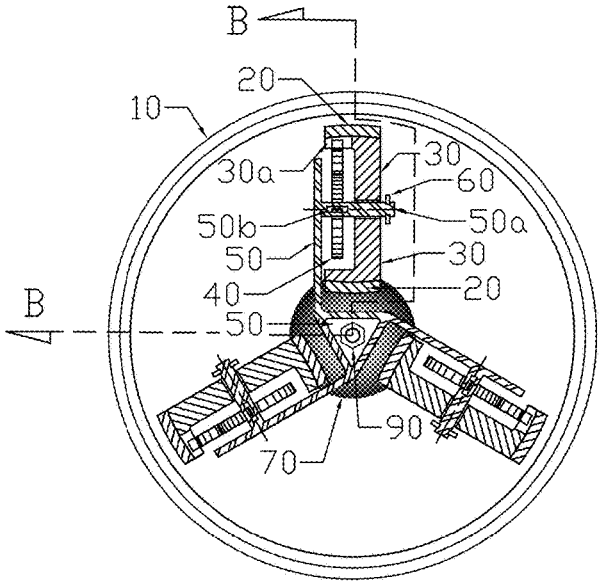
Section A-A
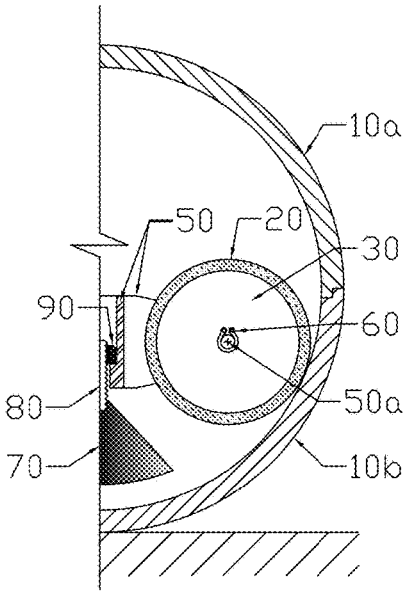
Section B-B
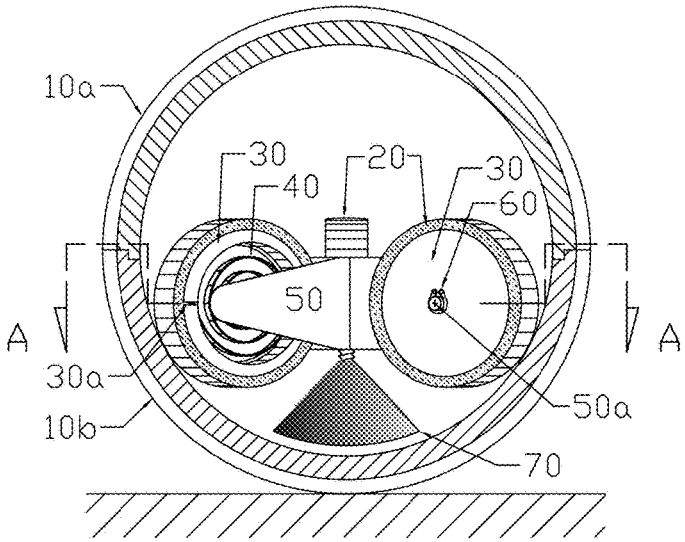

ROLLBACK BALL

CROSS REFERENCE TO RELATED APPLICATION

This application is entitled to the benefit of Provisional Patent Application No. 62/178,808 filing dated Apr. 21, 2015 under the title of Ballmerang.

BACKGROUND OF THE INVENTION

For centuries rollback cans or comeback cans were made as play toys. When rolling on the floor, the can rolls, stops, and returns back by itself along the same path to the same launching destination. The rollback can is made of a round cylinder can with both end lids, a rubber band tied between the centers of both lids, and a weight anchored at the middle of the rubber band and hung above the bottom of the cylinder. Another method of making the rollback can is to use a shaft and a spiral coil spring. The shaft is extended through the centers of the can's lids. A weight is anchored at the center of the shaft. The inner end of the spring is attached to the shaft and the outer end of the spring is attached to the cylinder. When rolling, kinetic energy from the rotating can is transferred to potential energy stored in the rubber band or spring. Once the can stops, the rubber band or spring releases its potential energy rolling the can back along the same path to the same launching destination.

Some manufacturers make the rollback can shape like a ball. The mechanism inside the ball is the same as the mentioned mechanism inside the rollback can. In order for the ball to rolling back, it has to be rolled only in the direction, perpendicular to the rubber band string or shaft, like the rollback can. The ball cannot roll back in other directions.

U.S. patent US 2005/0107192 A1 "Rolling Play Toy" provides a method of varying the center of mass of the ball by adjustable bolt heads from the nuts embedded in the ball. When rolling, the bolt heads move and rotate with the ball in one solid piece. Different positions of bolt heads give different trajectories. However, all of the trajectories that are potentially attainable are curves and not a straight line. Also, most of the trajectories cannot return to the same destination.

There is no prior art similar to my invention that a ball with a novel mechanical tracking device that can return by itself on the same straight line path to the same or approximately the same destination from which it was launched from any angle on a level floor

BRIEF SUMMARY OF THE INVENTION

In accordance with the present invention, Rollback Ball or Ballmerang is comprised of a ball shell and a mechanical tracking device that leans against the shell and floats above the bottom of the shell. The tracking device consists of three or more wheels with high coefficients of friction tires, spiral coil springs, a weight, and a supporting frame. When rolling the ball on a level floor, the ball rolls in a straight line. Gravity pulls and maintains the weight in the vertical position preventing the tracking device from rotating with the shell. The tires rotate from friction forces and tracking the ball rotation. The degree of rotation of each wheel depends on its position related to the ball's moving path. The rotating wheels will wind the springs and convert kinetic energy of the rolling ball to potential energy which is stored in the springs.

Once the ball stops rolling, the springs unwind releasing their potential energy. The wheels reverse rotations proportionally to the amount of the stored potential energy. The tires drive the ball back on the same straight line path to the same or approximately the same destination from which it was launched.

A second method of tracking and driving the ball back is to use magnetic forces instead of the friction forces as previously described. The configuration of the magnetic force tracking system is the same for the friction force tracking system, except for the wheels are made of magnetic material and the shell is made of ferrous material. Instead of using the friction forces to rotate the tires, the magnetic tires use the magnetic forces pulling and adhering to the ferrous ball; when the ball rotates the magnetic tires rotate and track the ball.

Unlike the rollback can that can be rolled only in one direction, the Rollback Ball can be rolled in any direction. Also, unlike the patented Rolling Play Toy where all of the potentially attainable trajectories are curves and every piece in the ball rotates together with the ball as one solid piece; the Rollback Ball's trajectory is a straight line and the mechanical tracking device does not rotate with the shell as one solid piece.

BRIEF DESCRIPTION OF THE DRAWINGS

FIG. 1: Cross section of the shell to depict a full vertical view of the tracking device.

Section A-A: A horizontal cross-section of the tracking device.

Section B-B: A partial vertical section of the weight, supporting frame, and point of contact between the ball and the wheel.

DETAILED DESCRIPTION OF THE INVENT

An embodiment of the Rollback Ball or Ballmerang is illustrated in FIG. 1, section A-A, and section B-B. In accordance with the present invention the Rollback Ball consists of two hemisphere shells 10*a* and 10*b* coupled together to form a hollow ball or a ball shell 10, and a mechanical tracking device leans against the shell 10 and floats above the bottom of the shell 10. The tracking device consists of three or more wheels 30 with tires 20, spiral coil springs 40, a weight 70, and a supporting frame 50. The tires 20 are made of materials with high coefficients of friction such as rubber or synthetic rubber. The shell 10, wheels 30, weight 70, supporting frame 50, and shafts are made of plastic or metal. An alternative to having the tires 20 making of high friction materials is to have the shell 10 made of high friction materials; consequently, the tires 20 will have to be made of plastic or metal. The tires 20 lean against the shell 10; the wheels 30 and tires 20 freely rotate around the shafts 50*a* which are supported by and attached to the supporting frame 50. The wheels 30 and supporting frame 50 are arranged in a symmetrical pattern. The outer end of the spiral coil springs 40 are anchored in the notched 30*a* located at the outer edge of the wheels 30 and the center end of the springs 40 are anchored in the slots 50*b* located in the shafts 50*a*. The weight 70, hanging above the bottom of the ball 10, is attached to the threaded rod 80 that is inserted into the supporting frame 50 and is secured by a nut 90. The retaining rings 60 are installed at the shafts 50*a* to prevent the wheels 30 from slipping out of the shafts 50*a*.

When rolling the Rollback Ball without spinning on a level floor and with a force that generates kinetic energy below potential energy that could be stored by the springs 40, the ball will roll in a straight line. Gravity will pull and maintain the weight 70 in the vertical position preventing the tracking device from rotating with the shell 10.

If the wheel's position is in line with the ball's moving path, the tire 20 will rotate from the friction force rubbing against the shell 10 and fully track the whole length of the ball's moving path. The wheel 30 will wind in or wind out (depended on the spring's pattern either clockwise or counter-clockwise) the spring 40 and convert kinetic energy of the rolling ball to potential energy stored in the spring 40. If the wheel's position is perpendicular to the ball's moving path, the tire 20 will not rotate or wind the spring 40, and thus stores no potential energy. If the wheel's position is in between the two mentioned positions the tire 20 will rotate and store potential energy accordingly to its position.

Each wheel 30 in the tracking device has a position related to the ball's moving path differently from the other wheels 30. Thus, each wheel 30 will rotate and store energy differently from the other wheels 30. Once the ball stops rolling, the springs 40 will unwind releasing their potential energy, the wheels 30 will reverse their rotations proportionally to the amount of their stored potential energy, the tires 20 will drive the shell 10 and the ball back at the same straight line path to the same or approximately the same destination from which it was launched. With the novel mechanical tracking device, the ball can return back when rolling in any ball's direction on a flat floor.

The second embodiment of the Rollback Ball or Ballmerang is to use magnetic forces instead of the friction forces to track and drive the ball back. For this embodiment, the tires 20 are made of magnetic materials and the shell 10 is made of materials that are attracted to magnets, such as ferrous metal or ferrous alloy. Instead of using the friction forces tracking the ball as previously described, the magnetic tires 20 use magnetic forces pulling and adhering to the ferrous shell 10. When the shell 10 rotates the magnetic tires 20 rotate tracking the shell 10, and vice versa when the magnetic tires 20 rotate.

What is claimed is:

1. A rollback ball comprising a ball shell and a mechanical tracking device, wherein the mechanical tracking device is housed inside the ball shell and wherein a. the ball shell comprises an inner wall; and b. the mechanical tracking device comprises a symmetrical supporting frame with three symmetrical arms and three shafts, each shaft protruding perpendicularly from each arm of the frame, three wheels, wherein each wheel has a tire thereon, three spiral coil springs, wherein each coil spring is positioned within each wheel and has an outer end and a center end, and a weight, wherein each of the three wheels is symmetrically arranged around the frame and supported on one of the three shafts, rotates freely thereon, and the tire on each of the wheels leans against the inner wall of the shell;

each wheel comprises a notch and each shaft comprises a slot, wherein the outer end of each coil spring is anchored to the notch and the center end of each coil spring is anchored to the slot, so that each coil spring is wound around each shaft when each wheel rotates; and the weight is attached to a center of the symmetrical supporting frame at a bottom, wherein the inner wall of the ball shell comprises a bottom and the weight floats above the bottom of the inner wall of the ball shell, and the weight is configured to prevent the tracking device from rotating within the ball.

2. The rollback ball according to claim 1, wherein the ball shell comprises two hemisphere shells.

3. The rollback ball according to claim 1, wherein each wheel comprises an outer edge and the notch is in the outer edge of each wheel.

4. The rollback ball according to claim 1, wherein the shafts further comprise retaining rings to retain the wheels to the shafts.

5. The rollback ball according to claim 1, wherein the tires comprise rubber or synthetic rubber.

6. The rollback ball according to claim 1, wherein the ball shell comprises a high friction material and the tires comprise plastic or metal.

7. The rollback ball according to claim 1, wherein the ball shell comprises ferrous metal or ferrous alloy and the tires comprise a magnetic material.

8. The rollback ball according to claim 1, wherein the weight is attached to the symmetrical supporting frame with a threaded rod and secured by a nut.

9. A method, comprising the steps of a. providing the rollback ball of claim 1;

b. rolling the rollback ball from a start position to a stop position, wherein the rolling winds the spring anchored to one of the wheels, such that when the rollback ball reaches the stop position, the spring unwinds to roll the rollback ball to a second stop position.

10. The method of claim 9, wherein the start and second stop positions are the same or approximately the same.

11. The method of claim 9, wherein the spring winds in the clockwise direction and unwinds in the counterclockwise direction.

12. The method of claim 9, wherein the spring winds in the counterclockwise direction and unwinds in the clockwise direction.

13. The method of claim 9, wherein the rolling winds springs anchored to two of the wheels.

* * * * *